US007364417B2

(12) United States Patent
Hwang et al.

(10) Patent No.: US 7,364,417 B2
(45) Date of Patent: Apr. 29, 2008

(54) COMPRESSION UNIT OF ORBITING VANE COMPRESSOR

(75) Inventors: Seon-woong Hwang, Anyang-Si (KR); Dong-won Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 47 days.

(21) Appl. No.: 11/111,844

(22) Filed: Apr. 22, 2005

(65) Prior Publication Data

US 2006/0073054 A1 Apr. 6, 2006

(30) Foreign Application Priority Data

Oct. 6, 2004 (KR) ..... 10-2004-0079610
Oct. 6, 2004 (KR) ..... 10-2004-0079615
Oct. 6, 2004 (KR) ..... 10-2004-0079629

(51) Int. Cl.
*F04C 18/04* (2006.01)

(52) U.S. Cl. ..... 418/59; 418/6; 418/140

(58) Field of Classification Search ..... 418/54, 418/59, 61.1, 140, 141, 143, 6
See application file for complete search history.

(56) References Cited

U.S. PATENT DOCUMENTS 919,058 A * 4/1909 Mortensen ..... 418/57
1,560,624 A * 11/1925 Varley ..... 418/59
2,073,101 A * 3/1937 Fox ..... 418/59
2,561,280 A * 7/1951 Kampf ..... 418/59
3,073,118 A * 1/1963 August ..... 123/213
3,125,031 A * 3/1964 Rydberg et al. ..... 418/59
3,125,032 A * 3/1964 Smith ..... 418/59
3,812,828 A * 5/1974 Griffiths ..... 418/61.1
4,235,572 A * 11/1980 Winkler et al. ..... 418/59
6,203,301 B1 * 3/2001 Kim ..... 418/6
6,547,534 B1 * 4/2003 Sakamoto et al. ..... 417/244
6,676,392 B1 * 1/2004 Hwang et al. ..... 418/59
6,896,493 B2 5/2005 Chang et al.

FOREIGN PATENT DOCUMENTS

JP 2001-82332 3/2001
KR 2004-7984 1/2004

OTHER PUBLICATIONS

U.S. Appl. No. 11/111,849.
U.S. Appl. No. 11/111,861.
U.S. Appl. No. 11/111,863.
U.S. Appl. No. 11/111,881.
U.S. Appl. No. 11/111,851.

* cited by examiner

*Primary Examiner*—Thomas Denion
*Assistant Examiner*—Mary A Davis
(74) *Attorney, Agent, or Firm*—Greenblum & Bernstein, P.L.C.

(57) ABSTRACT

Disclosed herein is a compression unit of an orbiting vane compressor having improved tight contact between a circular vane and sealing means wherein the sealing means can be easily manufactured. The compression unit compresses refrigerant gas introduced by an orbiting movement of a circular vane in an annular space defined between the inner wall of a cylinder and an inner ring. The compression unit comprises a first horizontal contact surface formed at the outer circumferential surface of the inner ring, a second horizontal contact surface formed at the inner wall of the cylinder while being parallel with the first horizontal contact surface, and a linear slider disposed in an opening formed at the circular vane for performing a linear reciprocating movement along the first and second horizontal contact surfaces.

16 Claims, 11 Drawing Sheets

Prior Art

Prior Art

Prior Art

COMPRESSION UNIT OF ORBITING VANE COMPRESSOR

CROSS-REFERENCE TO RELATED APPLICATIONS

This application claims foreign priority under 35 U.S.C. § 119(*a*) - (*d*) to Korean Patent Application No. 10-2004-0079610 filed on 6 Oct. 2004; Korean Patent Application No. 10-2004-0079615, filed on 6 Oct. 2004; and Korean Patent Application No. 10-2004-0079629 filed on 6 Oct. 2004.

BACKGROUND OF THE INVENTION

1. Field of the Invention

The present invention relates to an orbiting vane compressor, and, more particularly, to a compression unit of an orbiting vane compressor having improved tight contact between a circular vane and sealing means wherein the sealing means can be easily manufactured.

2. Description of the Related Art

Referring to FIG. 1, there is illustrated a conventional orbiting vane compressor. As shown in FIG. 1, a drive unit D and a compression unit P are mounted in a shell 1 while the drive unit D and the compression unit P are hermetically sealed. The drive unit D and the compression unit P are connected to each other via a vertical crankshaft 8, the upper and lower ends of which are rotatably supported by a main frame 6 and a subsidiary frame 7, such that power from the drive unit D is transmitted to the compression unit P through the crankshaft 8.

The drive unit D comprises: a stator 2 fixedly disposed between the main frame 6 and the subsidiary frame 7; and a rotor 3 disposed in the stator 2 for rotating the crankshaft 8, which vertically extends through the rotor 3, when electric current is supplied to the rotor 3. The rotor 3 is provided at the top and bottom parts thereof with balance weights 3*a*, which are disposed symmetrically to each other for preventing the crankshaft 8 from being rotated in an unbalanced state due to a crank pin 81.

The compression unit P comprises an orbiting vane 5 having a boss 55 formed at the lower part thereof. The crank pin 81 is fixedly fitted in the boss 55 of the orbiting vane 5. As the orbiting vane 5 performs an orbiting movement in a cylinder 4, refrigerant gas introduced into the cylinder 4 through an inlet tube 11 is compressed. The cylinder 4 comprises an inner ring 41 integrally formed at the upper part thereof while being protruded downward. The orbiting vane 5 comprises a circular vane 51 formed at the upper part thereof while being protruded upward. The circular vane 51 performs an orbiting movement in an annular space 42 defined between the inner ring 41 and the inner wall of the cylinder 4. Through the orbiting movement of the circular vane 51, inner and outer compression chambers are formed at the inside and the outside of the circular vane 51, respectively. Refrigerant gases compressed in the inner and outer compression chambers are discharged out of the cylinder 4 through inner and outer outlet ports 44 and 44*a* formed at the upper part of the cylinder 4, respectively.

Between the main frame 6 and the orbiting vane 5 is disposed an Oldham's ring 9 for preventing rotation of the orbiting vane 5. Through the crankshaft 8 is longitudinally formed an oil supplying channel 82 for allowing oil to be supplied to the compression unit P therethrough when an oil pump 83 mounted at the lower end of the crankshaft 8 is operated.

Unexplained reference numeral 1*a* indicates an inlet tube, 1*b* a high-pressure chamber, and 1*c* an outlet tube.

FIG. 2 is an exploded perspective view illustrating the structure of the compression unit P shown in FIG. 1.

In the compression unit P of the orbiting vane compressor, as shown in FIG. 2, the orbiting vane 5, which is connected to the crankshaft 8, is disposed on the upper end of the main frame 6, which rotatably supports the upper part of the crankshaft 8. The cylinder 4, which is attached to the main frame 6, is disposed above the orbiting vane 5. The cylinder 4 is provided at a predetermined position of the circumferential part thereof with an inlet port 43. The inner and outer outlet ports 44 and 44*a* are formed at predetermined positions of the upper end of the cylinder 4.

The crank pin 81 of the crankshaft 8 is fixedly fitted in the boss 55, which is formed at the lower surface of a vane plate 50 of the orbiting vane 5. At a predetermined position of the circumferential part of the circular vane 51 of the orbiting vane 5 is formed a through-hole 52 for allowing refrigerant gas introduced through the inlet port 43 of the cylinder 4 to be guided into the circular vane 51 therethrough. At another predetermined position of the circumferential part of the circular vane 51 of the orbiting vane 5, which is adjacent to the position where the through-hole 52 is disposed, is formed an opening 53. Sealing means 54 is disposed in the opening 53.

FIG. 3 is a cross-sectional view illustrating the operation of the conventional orbiting vane compressor shown in FIG. 1.

When the orbiting vane 5 of the compression unit P is driven by power transmitted to the compression unit P from the drive unit D through the crankshaft 8 (See FIG. 1), the circular vane 51 of the orbiting vane 5 disposed in the annular space 42 of the cylinder 4 performs an orbiting movement in the annular space 42 of the cylinder 4, as indicated by arrows, to compress refrigerant gas introduced into the annular space 42 through the inlet port 43.

At the initial orbiting position of the orbiting vane 5 of the compression unit P (i.e., the 0-degree orbiting position), refrigerant gas is introduced into an inner suction chamber A1 through the inlet port 43 and the through-hole 52 of the circular vane 51, and compression is performed in an outer compression chamber B2 of the circular vane 51 while the outer compression chamber B2 does not communicate with the inlet port 43 and the outer outlet port 44*a*. Refrigerant gas is compressed in an inner compression chamber A2, and at the same time, the compressed refrigerant gas is discharged out of the inner compression chamber A2 through the inner outlet port 44.

At the 90-degree orbiting position of the orbiting vane 5 of the compression unit P, the compression is still performed in the outer compression chamber B2 of the circular vane 51, and almost all the compressed refrigerant gas is discharged out of the inner compression chamber A2 through the inner outlet port 44. At this stage, an outer suction chamber B1 appears so that refrigerant gas is introduced into the outer suction chamber B1 through the inlet port 43.

At the 180-degree orbiting position of the orbiting vane 5 of the compression unit P, the inner suction chamber A1 disappears. Specifically, the inner suction chamber A1 is changed into the inner compression chamber A2, and therefore, compression is performed in the inner compression chamber A2. At this stage, the outer compression chamber B2 communicates with the outer outlet port 44*a*. Consequently, compressed refrigerant gas is discharged out of the outer compression chamber B2 through the outer outlet port 44*a*.

At the 270-degree orbiting position of the orbiting vane 5 of the compression unit P, almost all the compressed refrigerant gas is discharged out of the outer compression chamber B2 of the circular vane 51 through the outer outlet port 44*a*, and the compression is still performed in the inner compression chamber A2 of the circular vane 51. Also, compression is newly performed in the outer suction chamber B1. When the orbiting vane 5 of the compression unit P further performs the orbiting movement by 90 degrees, the outer suction chamber B1 disappears. Specifically, the outer suction chamber B1 is changed into the outer compression chamber B2, and therefore, the compression is continuously performed in the outer compression chamber B2. As a result, the orbiting vane 5 of the compression unit P is returned to the position where the orbiting movement of the orbiting vane 5 is initiated. In this way, a 360-degree-per-cycle orbiting movement of the orbiting vane 5 of the compression unit P is accomplished. The orbiting movement of the orbiting vane 5 of the compression unit P is repeatedly performed in succession.

The sealing means 54 is disposed between opposite sides of the circular vane 51, between which the opening 53 is defined, for maintaining the seal between the inner and outer compression chambers A2 and B2 of the circular vane 51. The sealing means 54 comprises a circular arc-shaped slider 54*a*. The opening 53 is also formed in the shape of a circular arc such that the circular arc-shaped slider 54*a* is slidably disposed in the opening 54.

The circular arc-shaped slider 54*a* is also moved along with the circular vane 51 when the circular vane 51 is moved. Specifically, the circular arc-shaped slider 54*a* performs a curved reciprocating movement along the inner circumferential surface of the cylinder 4 while the circular arc-shaped slider 54*a* is in contact with the inner circumferential surface of the cylinder 4. At this time, both sides of the circular arc-shaped slider 54*a* are in linear contact with the opposite sides of the circular vane 51.

However, it is very difficult to manufacture the circular arc-shaped slider of the sealing means such that the circular arc-shaped slider can perform a curved reciprocating movement in the annular space, while being tightly disposed in the opening, according to the orbiting movement of the circular vane.

Also, the circular arc-shaped slider of the sealing means performs the curved reciprocating movement while being in linear contact with the opposite sides of the circular vane when the circular vane performs an orbiting movement. As a result, the length of tight contact between the sealing means and the circular vane is small. Consequently, the tight contact between the circular arc-shaped opening of the circular vane and the sealing means is considerably deteriorated, and the seal between the compression chambers is also deteriorated.

Furthermore, the performance of the compressor is also deteriorated as the tight contact between the circular arc-shaped opening of the circular vane and the sealing means and the seal between the compression chambers are deteriorated.

SUMMARY OF THE INVENTION

Therefore, the present invention has been made in view of the above problems, and it is an object of the present invention to provide a compression unit of an orbiting vane compressor having improved tight contact between a circular vane and sealing means, the sealing means being easily manufactured.

It is another object of the present invention to provide a compression unit of an orbiting vane compressor that is capable of preventing interference between a circular vane and the inner circumferential surface of a cylinder and preventing creation of dead volume between the circular vane and sealing means.

It is yet another object of the present invention to provide a compression unit of an orbiting vane compressor having sealing means that performs a linear reciprocating movement in an annular space defined in a cylinder according to an orbiting movement of a circular vane for maintaining the seal between low-pressure and high-pressure chambers formed in the cylinder wherein the sealing means is simply and accurately assembled.

In accordance with the present invention, the above and other objects can be accomplished by the provision of a compression unit of an orbiting vane compressor that compresses refrigerant gas introduced into the compression unit according to an orbiting movement of a circular vane in an annular space defined between the inner wall of a cylinder and an inner ring disposed in the cylinder, wherein the compression unit comprises: a first horizontal contact surface formed at the outer circumferential surface of the inner ring; a second horizontal contact surface formed at the inner wall of the cylinder while being parallel with the first horizontal contact surface; and a linear slider disposed in an opening formed at the circular vane for performing a linear reciprocating movement along the first and second horizontal contact surfaces.

Preferably, the circular vane has horizontal cut surfaces formed at the outer circumferential parts of the circular vane adjacent to the opening.

Preferably, the cylinder is provided with curved grooves, the curved grooves being formed at both sides of the second horizontal contact surface along the orbiting track of the outer circumferential parts of the circular vane adjacent to the opening.

Preferably, the circular vane further has first dead volume preventing protrusions formed at the inner circumferential parts of the circular vane adjacent to the opening.

Preferably, the linear slider is provided at both sides of the inner end thereof with second dead volume preventing protrusions, which are in contact with the inner circumferential parts of the circular vane adjacent to the opening, respectively.

Preferably, the compression unit further comprises: a leakage prevention part disposed at the linear slider.

Preferably, the leakage prevention part comprises: at least one first labyrinth seal formed at each of the inner and outer surfaces of the linear slider in the direction perpendicular to the linear reciprocating direction of the linear slider, the inner and outer surfaces of the linear slider being arranged in tight contact with the first and second horizontal contact surfaces.

Preferably, the leakage prevention part comprises: at least one second labyrinth seal formed at each of the upper and lower surfaces of the linear slider in the direction perpendicular to the linear reciprocating direction of the linear slider, the upper and lower surfaces of the linear slider being arranged at right angles to the inner wall of the cylinder and the inner ring.

Preferably, the first labyrinth seal extends to each of the upper and lower surfaces of the linear slider arranged at right angles to the inner wall of the cylinder and the inner ring, and the leakage prevention part further comprises: at least one second labyrinth seal formed at each of the upper and lower surfaces of the linear slider in the direction perpendicular to the linear reciprocating direction of the linear slider, the second labyrinth seal communicating with the first labyrinth seal.

Preferably, the leakage prevention part comprises: at least one third labyrinth seal formed at each of the first horizontal contact surface and the second horizontal contact surface in the direction perpendicular to the linear reciprocating direction of the linear slider.

Preferably, the cylinder is provided at a predetermined position of the circumferential part thereof with a separation space, and the compression unit further comprises: a slide housing releasably disposed in the separation space, the slide housing having the second horizontal contact surface.

Preferably, the cylinder is provided at the opposite sides thereof adjacent to the separation space with a pair of supporting bars each having a connection hole, and the slide housing has a fixing hole formed therethrough in the lateral direction thereof, the slide housing being attached to the cylinder by means of a bolt while the fixing hole of the slide housing is aligned with the connection holes of the supporting bars.

Preferably, the compression unit further comprises: at least one third labyrinth seal formed at each of the first and second horizontal contact surfaces of the cylinder in the direction perpendicular to the linear reciprocating direction of the linear slider.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 1:
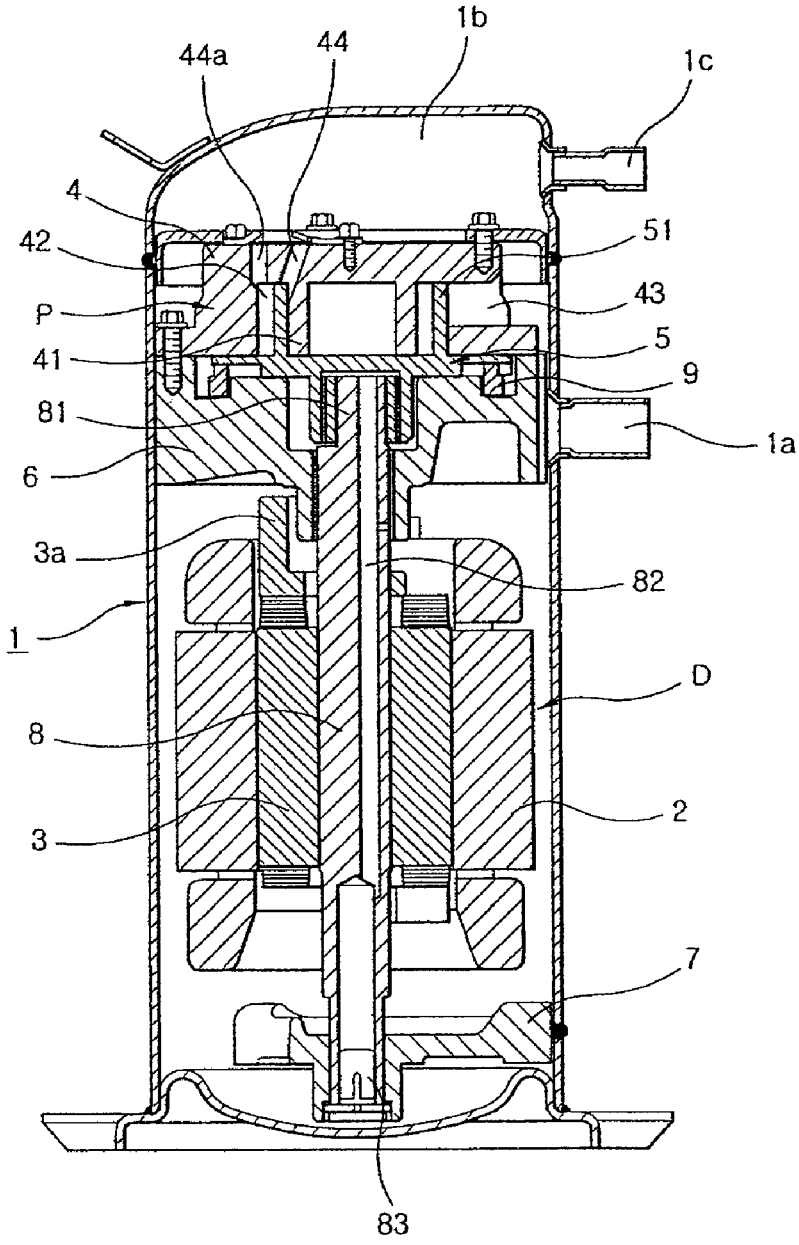
FIG. 1 is a longitudinal sectional view illustrating the overall structure of a conventional orbiting vane compressor.
Figure 2:
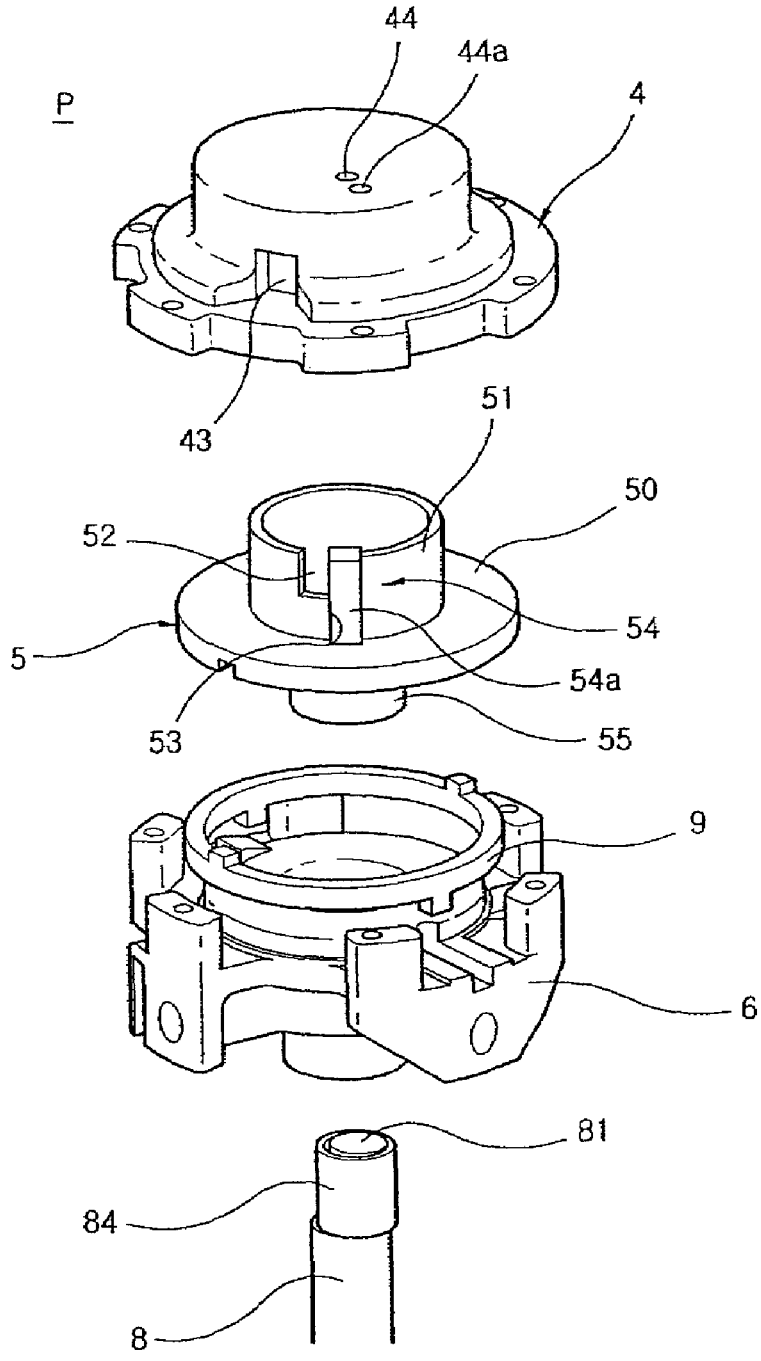
FIG. 2 is an exploded perspective view illustrating the structure of a compression unit of the conventional orbiting vane compressor shown in FIG. 1.
Figure 3:
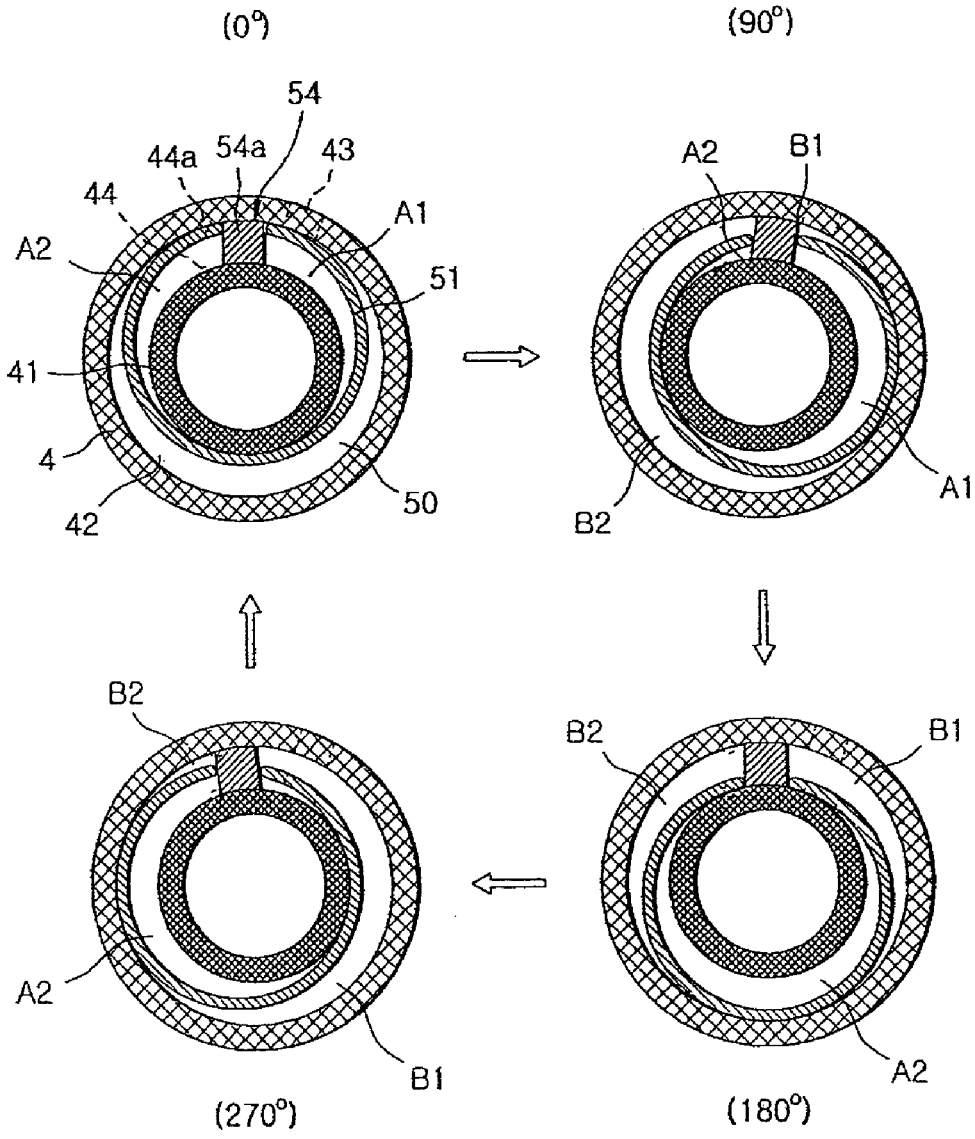
FIG. 3 is a cross-sectional view illustrating the operation of the conventional orbiting vane compressor shown in FIG. 1.
Figure 4:
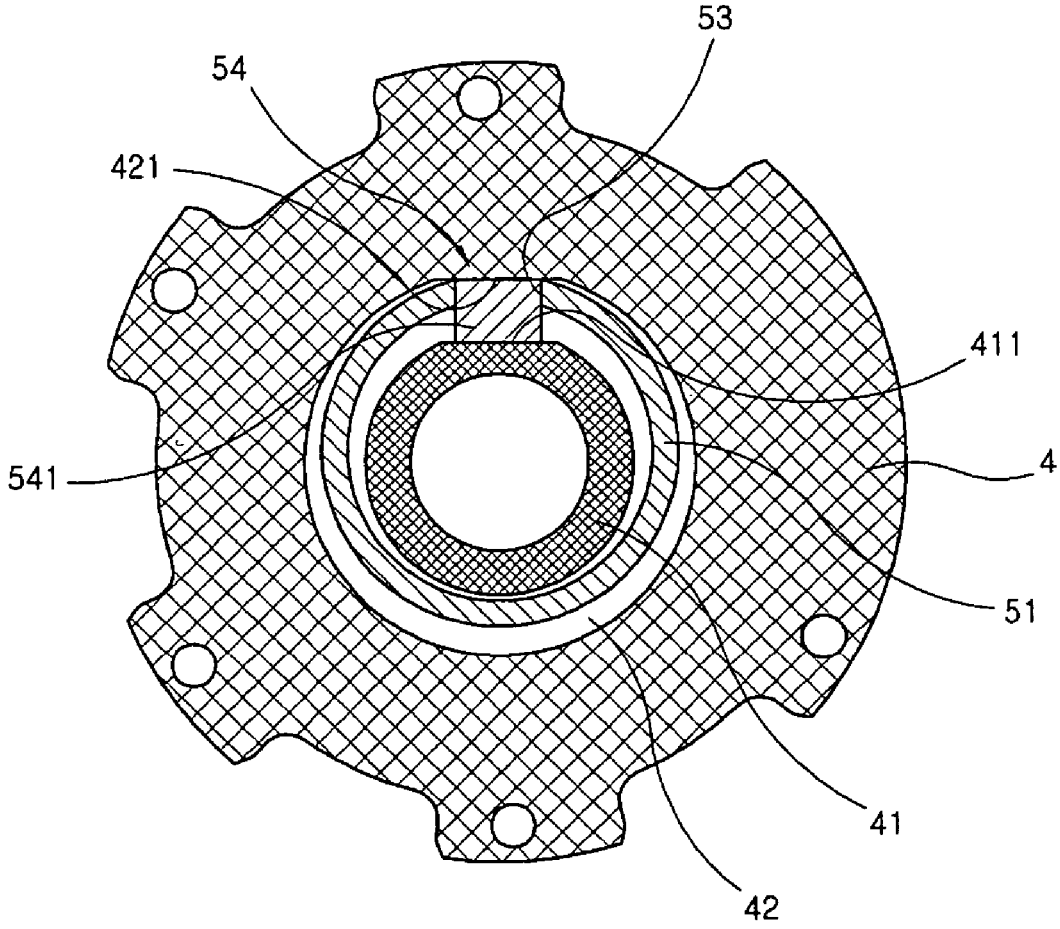
FIG. 4 is a cross-sectional view illustrating a compression unit of an orbiting vane compressor according to a first preferred embodiment of the present invention.

FIG. 4 is a cross-sectional view illustrating a compression unit of an orbiting vane compressor according to a first preferred embodiment of the present invention.

As shown in FIG. 4, the compression unit of the orbiting vane compressor according to the present invention comprises sealing means 54 that performs a linear reciprocating movement in an annular space defined in a cylinder while being tightly fitted in an opening formed at a circular vane 51 for maintaining the seal between a pair of compression chambers formed in the annular space 42 and, at the same time, maintaining the seal between suction chambers also formed in the annular space 42 and the compression chambers.

The sealing means 54 comprises a linear slider 541 disposed between a first horizontal contact surface 411 formed at an inner ring 41 of the cylinder 4 and a second horizontal contact surface 421 formed at the inner circumferential surface of the cylinder 4 for performing a linear reciprocating movement along the horizontal contact surfaces 411 and 421.

As the linear slider 541 performs the linear reciprocating movement along the horizontal contact surfaces 411 and 421, the linear slider 541 comes into horizontal tight contact with the opening 53 of the circular vane 51 when the circular vane 51 performs an orbiting movement. As a result, the horizontal tight contact between the linear slider 541 and the opening 53 is considerably improved.

As the horizontal tight contact between the linear slider 541 and the opening 53 is improved through the linear reciprocating movement of the linear slider 541, the seal between the pair of compression chambers formed at the inside and the outside of the circular vane 51 at one side of the linear slider 541 is adequately maintained.

Also, both side surfaces of the linear slider 541 are in surface contact with opposite sides of the circular vane 51, between which the opening 53 is defined. The length of tight contact between the linear slider 541 and the circular vane 51 is large. Consequently, the tight contact between the circular vane and the sealing means is considerably improved, and the seal between the compression chambers is also improved.

As the linear slider 541 performs a linear reciprocating movement while being in tight contact with the horizontal contact surfaces 411 and 421, the linear slider 541 maintains the seal between high-pressure compression chambers formed in the annular space 42 at one side of the linear slider 541 and low-pressure suction chambers formed in the annular space 42 at the other side of the linear slider 541. Consequently, the linear slider 541 prevents refrigerant gas compressed in the high-pressure compression chambers from being introduced into the low-pressure suction chambers, respectively, while isolating the high-pressure compression chambers and the corresponding low-pressure suction chambers from each other.

Figure 5:
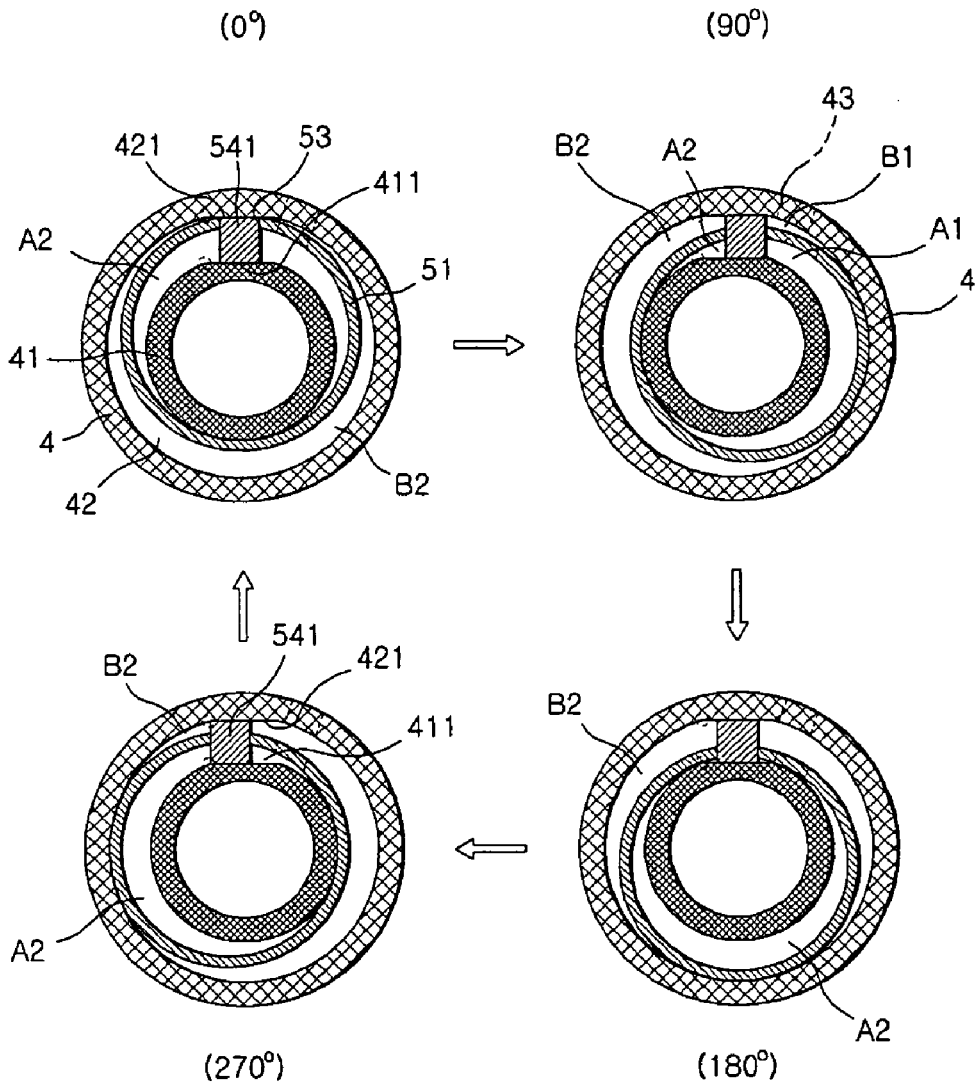
FIG. 5 is a cross-sectional view illustrating the operation of the compression unit of the orbiting vane compressor according to the first preferred embodiment of the present invention shown in FIG. 4.

FIG. 5 is a cross-sectional view illustrating the operation of the compression unit of the orbiting vane compressor according to the first preferred embodiment of the present invention shown in FIG. 4.

As shown in FIG. 5, refrigerant gas introduced into the annular space 42 through an inlet port 43 formed at the cylinder 4 is supplied into an inner suction chamber A1 and an outer suction chamber B1 formed at the inside and the outside of the circular vane 51 in the annular space 42.

In the annular space 42 defined between the inner circumferential surface of the cylinder 4 and the outer circumferential surface of the inner ring 41 are also formed an inner compression chamber A2 and an outer compression chamber B2, which are formed at the inside and the outside of the circular vane 51 as the circular vane 51 performs an orbiting movement.

The linear slider 541, which is disposed in the opening 53, while being in surface contact with the opposite sides of the circular vane 51, between which the opening 53 is defined, performs a linear reciprocating movement horizontally along the first horizontal contact surface 411 and the second horizontal contact surface 421 while the linear slider 541 is moved along with the circular vane 51 when the circular vane 51 performs an orbiting movement.

While the linear slider 541 performs the linear reciprocating movement in the horizontal direction during the orbiting movement of the circular vane 51 as described above, the linear slider 541 is kept in tight surface contact with the opposite sides of the circular vane 51.

As the linear slider 541 is kept in tight surface contact with the opposite sides of the circular vane 51 as described above, the length of tight contact between the linear slider 541 and the circular vane 51 is increased. Consequently, the seal between the inner compression chamber A2 and the outer compression chamber B2 is stably maintained.

As the linear slider 541 performs a linear reciprocating movement while being in tight contact with the horizontal contact surfaces 411 and 421, the linear slider 541 maintains the seal between a pair of compression chambers A2 and B2 formed in the annular space 42 at one side of the linear slider 541 and a pair of suction chambers A1 and B1 formed in the annular space 42 at the other side of the linear slider 541, respectively. Consequently, the linear slider 541 prevents refrigerant gas compressed in the compression chambers A2 and B2 from being introduced into the suction chambers A1 and B1, respectively.

Figure 6:
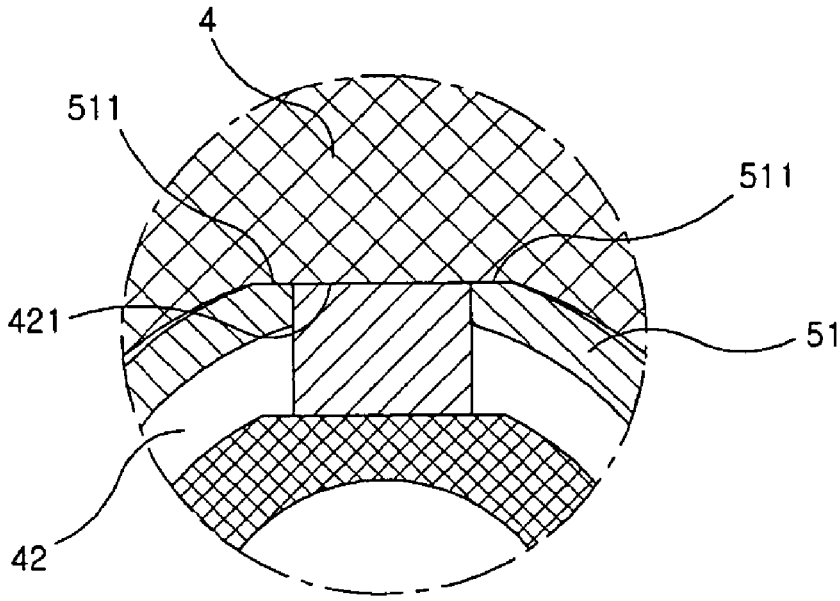
FIG. 6 is an enlarged cross-sectional view illustrating principal components of a compression unit of an orbiting vane compressor according to a second preferred embodiment of the present invention.

FIG. 6 is an enlarged cross-sectional view illustrating principal components of a compression unit of an orbiting vane compressor according to a second preferred embodiment of the present invention.

As shown in FIG. 6, the circular vane 51 has horizontal cut surfaces 511 formed at the outer circumferential parts of the circular vane 51 adjacent to the opening 53 in order to prevent the circular vane 51 from interfering with the second horizontal contact surface 421 formed at the inner circumferential surface of the cylinder 4.

The horizontal cut surfaces 511 of the circular vane 51 are formed to prevent friction and interference between the outer circumferential parts of the circular vane 51 adjacent to the opening 53 and the second horizontal contact surface 421. When the circular vane performs an orbiting movement, friction and interference between the outer circumferential parts of the circular vane 51 adjacent to the opening 53 and the second horizontal contact surface 421 is prevented by the horizontal cut surfaces 511.

Figure 7:
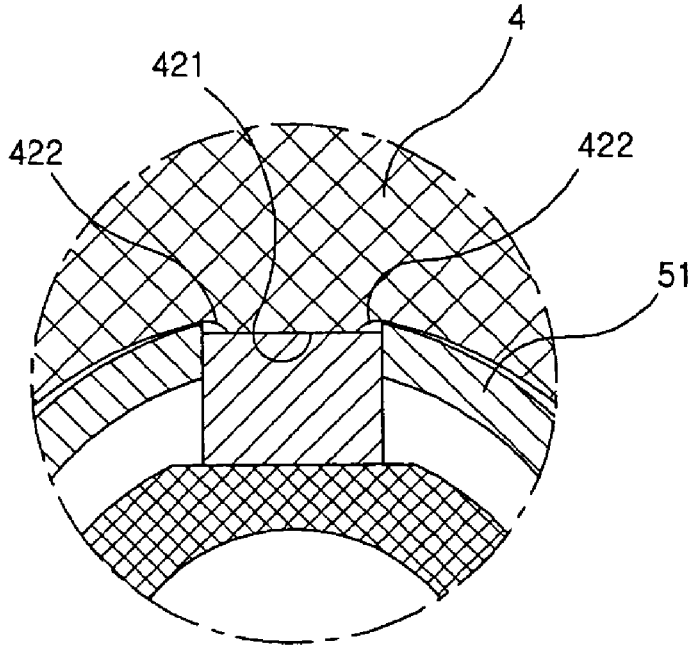
FIG. 7 is an enlarged cross-sectional view illustrating principal components of a compression unit of an orbiting vane compressor according to a third preferred embodiment of the present invention.

FIG. 7 is an enlarged cross-sectional view illustrating principal components of a compression unit of an orbiting vane compressor according to a third preferred embodiment of the present invention.

As shown in FIG. 7, the cylinder 4 is provided with curved grooves 422, which are formed at both sides of the second horizontal contact surface 421 along the orbiting track of the outer circumferential parts of the circular vane 51 adjacent to the opening 53 in order to prevent the circular vane 51 from interfering with the second horizontal contact surface 421 formed at the inner circumferential surface of the cylinder 4.

The curved grooves 422 are formed at the inner circumferential surface of the cylinder 4 to prevent friction and interference between the outer circumferential part of the circular vane 51 adjacent to the opening 53 and the second horizontal contact surface 421. When the circular vane performs an orbiting movement, friction and interference between the outer circumferential part of the circular vane 51 adjacent to the opening 53 and the second horizontal contact surface 421 is prevented by the curved grooves 422.

Figure 8:
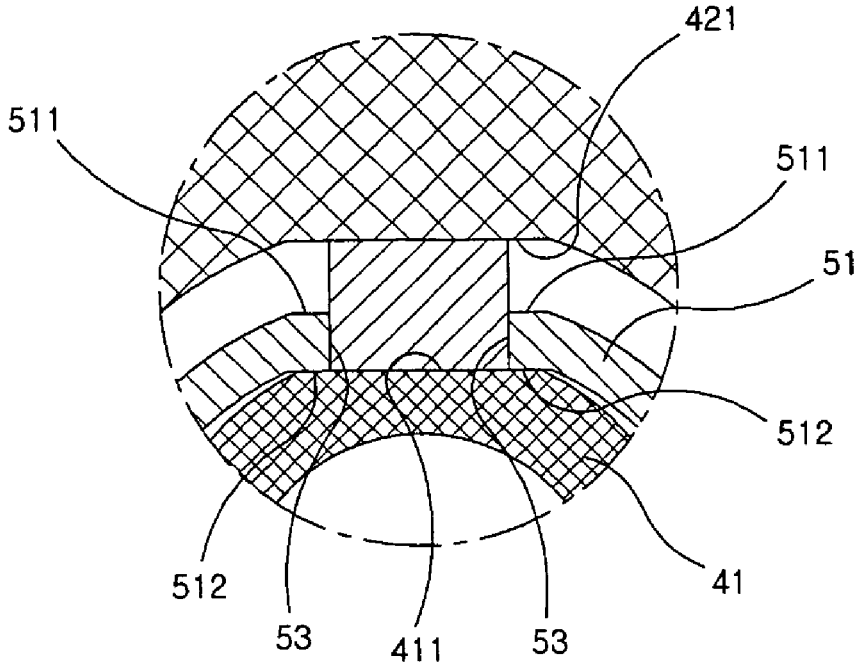
FIG. 8 is an enlarged cross-sectional view illustrating principal components of a compression unit of an orbiting vane compressor according to a fourth preferred embodiment of the present invention.

FIG. 8 is an enlarged cross-sectional view illustrating principal components of a compression unit of an orbiting vane compressor according to a fourth preferred embodiment of the present invention.

As shown in FIG. 8, the circular vane 51 has horizontal cut surfaces 511 formed at the outer circumferential parts of the circular vane 51 adjacent to the opening 53 in order to prevent the circular vane 51 and the second horizontal contact surface 421 formed at the inner circumferential surface of the cylinder 4 from interfering with each other. In addition, the circular vane 51 has first dead volume preventing protrusions 512 formed at the inner circumferential parts of the circular. vane 51 adjacent to the opening 53 in order to prevent creation of dead volume between the circular vane 51 and the first horizontal contact surface 411 of the inner ring 41.

The first dead volume preventing protrusions 512 prevent dead volume from being created between the inner circumferential parts of the circular vane 51 adjacent to the opening 53 and the first horizontal contact surface 411 of the inner ring 41 during the orbiting movement of the circular vane 51. The first dead volume preventing protrusions 512 are formed such that the inner circumferential parts of the circular vane 51 adjacent to the opening 53 are in tight contact with the first horizontal contact surface 411 of the inner ring 41.

As the dead volume is prevented from being created between the circular vane 51 and the first horizontal contact surface 411 of the inner ring 41 by the first dead volume preventing protrusions 512 as described above, abnormal compression or suction due to compressed or suctioned refrigerant gas received in the dead volume, if the dead volume is created, is effectively prevented.

Figure 9:
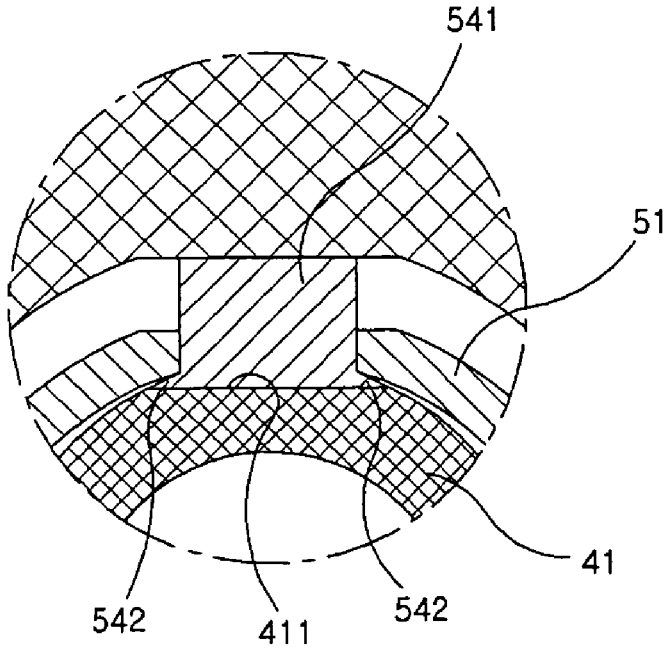
FIG. 9 is an enlarged cross-sectional view illustrating principal components of a compression unit of an orbiting vane compressor according to a fifth preferred embodiment of the present invention.

FIG. 9 is an enlarged cross-sectional view illustrating principal components of a compression unit of an orbiting vane compressor according to a fifth preferred embodiment of the present invention.

As shown in FIG. 9, the linear slider 541 is provided at both sides of the inner end thereof with second dead volume preventing protrusions 542 for preventing creation of dead volume between the inner circumferential parts of the circular vane 51 adjacent to the opening 53 and the first horizontal contact surface 411 of the inner ring 41.

Specifically, the second dead volume preventing protrusions 542 are formed, in a shape corresponding to the dead volume created between the inner circumferential parts of the circular vane 51 adjacent to the opening 53 and the first horizontal contact surface 411 of the inner ring 41, at both sides of the inner end of the linear slider 541 in order to prevent the dead volume from being created between the inner circumferential parts of the circular vane 51 adjacent to the opening 53 and the first horizontal contact surface 411 of the inner ring 41 during the orbiting movement of the circular vane 51.

As the dead volume is prevented from being created between the circular vane 51 and the first horizontal contact surface 411 of the inner ring 41 by the second dead volume preventing protrusions 542 as described above, abnormal compression or suction due to compressed or suctioned refrigerant gas received in the dead volume, if the dead volume is created, is effectively prevented.

Figure 10:
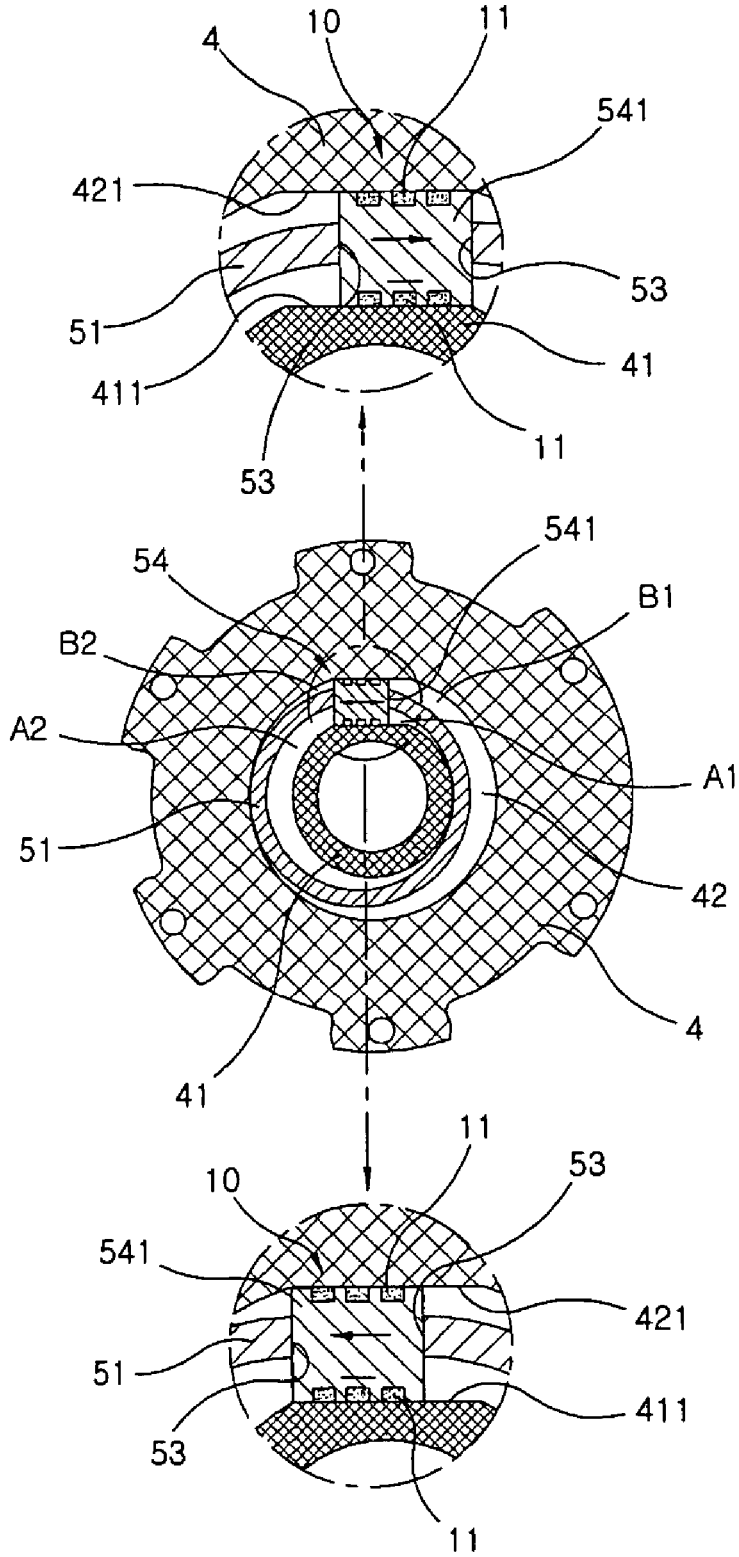
FIG. 10 is a cross-sectional view illustrating principal components of a compression unit of an orbiting vane compressor according to a sixth preferred embodiment of the present invention.
Figure 11:
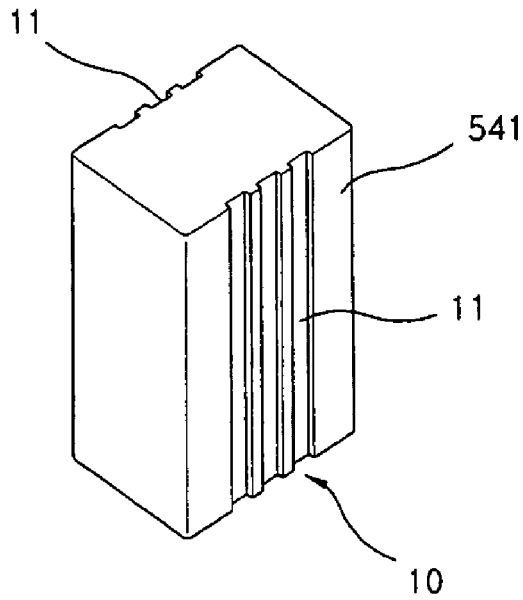
FIG. 11 is a perspective view illustrating the principal components of the compression unit of the orbiting vane compressor according to the sixth preferred embodiment of the present invention shown in FIG. 10.

FIG. 10 is a cross-sectional view illustrating principal components of a compression unit of an orbiting vane compressor according to a sixth preferred embodiment of the present invention, and FIG. 11 is a perspective view illustrating the principal components of the compression unit of the orbiting vane compressor according to the sixth preferred embodiment of the present invention shown in FIG. 10.

As shown in FIGS. 10 and 11, the linear slider 541 of the sealing means 54 is disposed in the opening 53 of the circular vane 51, and performs a linear reciprocating movement, while the linear slider 541 is in tight contact with not only the first horizontal contact surface 411 formed at the inner ring 41 of the cylinder 4 but also the second horizontal contact surface 421 formed at the inner circumferential surface of the cylinder 4, when the circular vane performs an orbiting movement.

The linear slider 541 has a leakage prevention part 10 for preventing compressed gas from leaking between a pair of compression chambers A2 and B2 formed in the annular space 42 at one side of the linear slider 541 and a pair of suction chambers A1 and B1 formed in the annular space 42 at the other side of the linear slider 541 during the linear reciprocating movement of the linear slider 541 along the horizontal contact surfaces 411 and 421.

The leakage prevention part 10 comprises a plurality of first labyrinth seals 11 formed at the inner and outer surfaces of the linear slider 541, which are in tight contact with the horizontal contact surfaces 411 and 421, in the direction perpendicular to the linear reciprocating direction of the linear slider 541, respectively.

Specifically, the first labyrinth seals 11 are vacant spaces formed at the inner and outer surfaces of the linear slider 541 in the direction perpendicular to the linear reciprocating direction of the linear slider 541. When refrigerant gases compressed in the compression chambers A2 and B2 of the annular space 42 flow to the suction chambers A1 and B2 through gaps defined between the inner and outer surfaces of the linear slider 541 and the horizontal contact surfaces 411 and 421, respectively, the refrigerant gases abruptly expand in the first labyrinth seals 11. As a result, the pressure of the refrigerant gases is decreased.

As the pressure of the refrigerant gases, abruptly expanding in the first labyrinth seals 11, is decreased as described above, the refrigerant gases lose their energy. Consequently, the refrigerant gases stagnate in the first labyrinth seals 11, and therefore, the compressed refrigerant gases are prevented from passing through the gaps between the inner and outer surfaces of the linear slider 541 and the horizontal contact surfaces 411 and 421, respectively. In this way, leakage of the compressed refrigerant gases is prevented.

Preferably, the first labyrinth seals 11 are formed, in large numbers, at the inner and outer surfaces of the linear slider 541, respectively, such that the inner and outer surfaces of the linear slider 541 are uneven with prominences and depressions, respectively. Consequently, the pressure of the compressed gases is decreased in a multi-stage fashion while the compressed gases pass through the first labyrinth seals 11, and therefore, the refrigerant gases compressed in the high-pressure compression chambers A2 and B2 are effectively prevented from leaking into low-temperature suction chambers A1 and B1 through the gaps between the inner and outer surfaces of the linear slider 541 and the horizontal contact surfaces 411 and 421, respectively.

As described above, the first labyrinth seals 11 are formed, in large numbers, at the inner and outer surfaces of the linear slider 541 in the direction perpendicular to the linear reciprocating direction of the linear slider 541. Consequently, leakage of the compressed gases is prevented in a multi-stage fashion, and therefore, the compressed gases are thoroughly prevented from leaking through the gaps between the inner and outer surfaces of the linear slider 541 and the horizontal contact surfaces 411 and 421.

Figure 12:
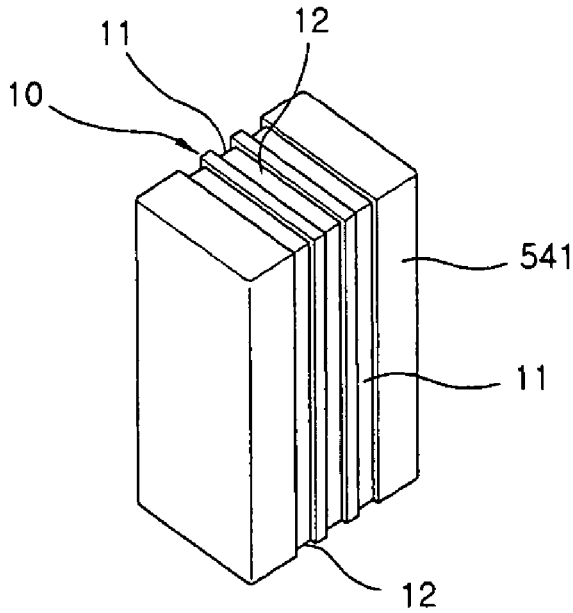
FIG. 12 is a perspective view illustrating principal components of a compression unit of an orbiting vane compressor according to a seventh preferred embodiment of the present invention.

FIG. 12 is a perspective view illustrating principal components of a compression unit of an orbiting vane compressor according to a seventh preferred embodiment of the present invention.

As shown in FIG. 12, the leakage prevention part 10 of the linear slider 541 comprises a plurality of second labyrinth seals 12 formed at the upper and lower surfaces of the linear slider 541, which are in contact with the upper and lower surfaces of the cylinder 4, in the direction perpendicular to the linear reciprocating direction of the linear slider 541. The upper and lower surfaces of the linear slider 541 are arranged at right angles to the inner wall of the cylinder 4 and the inner ring 41.

Specifically, the second labyrinth seals 12 are vacant spaces formed at the upper and lower surfaces of the linear slider 541 in the direction perpendicular to the linear reciprocating direction of the linear slider 541. When refrigerant gases compressed in the compression chambers A2 and B2 of the annular space 42 flow to the suction chambers A1 and B2 through gaps defined between the upper and lower surfaces of the linear slider 541 and the upper and lower surfaces of the cylinder 4, respectively, the refrigerant gases abruptly expand in the second labyrinth seals 12. As a result, the pressure of the refrigerant gases is decreased.

As the pressure of the refrigerant gases, abruptly expanding in the second labyrinth seals 12, is decreased as described above, the refrigerant gases lose their energy. Consequently, the refrigerant gases stagnate in the second labyrinth seals 12, and therefore, the compressed refrigerant gases are prevented from passing through the gaps between the upper and lower surfaces of the linear slider 541 and the upper and lower surfaces of the cylinder 4, respectively. In this way, leakage of the compressed refrigerant gases is prevented in a multi-stage fashion.

Preferably, the number of the second labyrinth seals 12 is equal to that of the first labyrinth seals 11, and the second labyrinth seals 12 formed at the upper and lower surfaces of the linear slider 541 are connected in communication with the first labyrinth seals 11 are formed at the inner and outer surfaces of the linear slider 541, respectively.

As the second labyrinth seals 12 are connected in communication with the first labyrinth seals 11 as described above, the first labyrinth seals 11 and the second labyrinth seals 12, which together constitute the leakage prevention part 10, are formed over the entire surfaces of the linear slider 541, and therefore, the compressed gases are prevented from leaking through the gaps between the inner and outer surfaces of the linear slider 541 and the horizontal contact surfaces 411 and 421 and the gaps between the upper and lower surfaces of the linear slider 541 and the upper and lower surfaces of the cylinder 4, respectively.

As described above, the compressed gases leaking during the linear reciprocating movement of the linear slider 541 are introduced into the first labyrinth seals 11 and the second labyrinth seals 12 formed, in large numbers, at the inner and outer surfaces of the linear slider 541 and the upper and lower surfaces of the linear slider 541, respectively, and then expand in the first labyrinth seals 11 and the second labyrinth seals 12. Consequently, leakage of the compressed gases is prevented in a multi-stage fashion. As a result, the compressed refrigerant gases are prevented from passing through the gaps between the inner and outer surfaces of the linear slider 541 and the horizontal contact surfaces 411 and 421 and the gaps between the upper and lower surfaces of the linear slider 541 and the upper and lower surfaces of the cylinder 4, respectively, and therefore, leakage of the compressed refrigerant gases is prevented.

Figure 13:
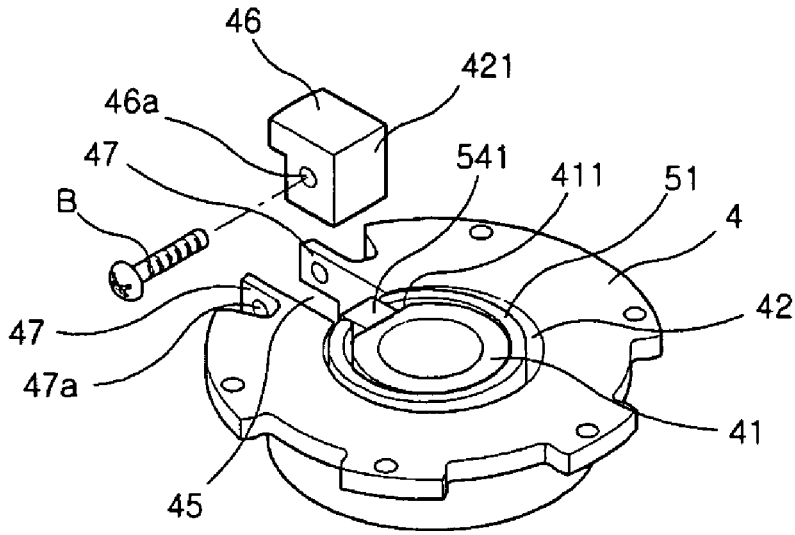
FIG. 13 is an exploded perspective view illustrating a compression unit of an orbiting vane compressor according to an eighth preferred embodiment of the present invention.

FIG. 13 is an exploded perspective view illustrating a compression unit of an orbiting vane compressor according to an eighth preferred embodiment of the present invention.

As shown in FIG. 13, the annular space 42 is defined between the inner ring 41 and the inner wall of the cylinder 4, and the circular vane 51 performs an orbiting movement in the annular space 42.

The linear slider 541, which is disposed between the opposite sides of the circular vane 51, performs a linear reciprocating movement along the first horizontal contact surface 411 of the inner ring 41 and the second horizontal contact surface 421 of the cylinder 4, when the circular vane 51 performs the orbiting movement in the annular space 42 defined between the inner ring 41 and the inner wall of the cylinder 4, for maintaining the seal between the compression chambers and, at the same time, maintaining the seal between the high-pressure compression chambers and the low-pressure suction chambers, respectively.

The cylinder 4 is provided at a predetermined position of the circumferential part thereof with a separation space 45. In the separation space 45 is disposed a slide housing 46. The slide housing 46 has a second horizontal contact surface 421.

Specifically, a pair of supporting bars 47, each having a connection hole 47*a*, are integrally formed at the opposite sides of the cylinder 4 adjacent to the separation space 45, and a fixing hole 46*a* is formed through the slide housing 46 in the lateral direction thereof. The slide housing 46 is fitted in the separation space 45 formed at the cylinder 4 while the fixing hole 46*a* of the slide housing 46 is aligned with the connection holes 47*a* of the supporting bars 47, and then a bolt B is inserted through one of the connection holes 47*a*, the fixing hole 46*a*, and the other connection hole 47*a*. In this way, the slide housing 46 is detachably attached to the cylinder 4.

As the slide housing 46 is disposed in the separation space 45 of the cylinder 4 as described above, it is possible to adjust the gap between the second horizontal contact surface 421 of the slide housing 46 and the linear slider 541, which is in contact with the second horizontal contact surface 421 of the slide housing 46. Also, it is possible to easily and stably assemble and replace the linear slider 541.

Figure 14:
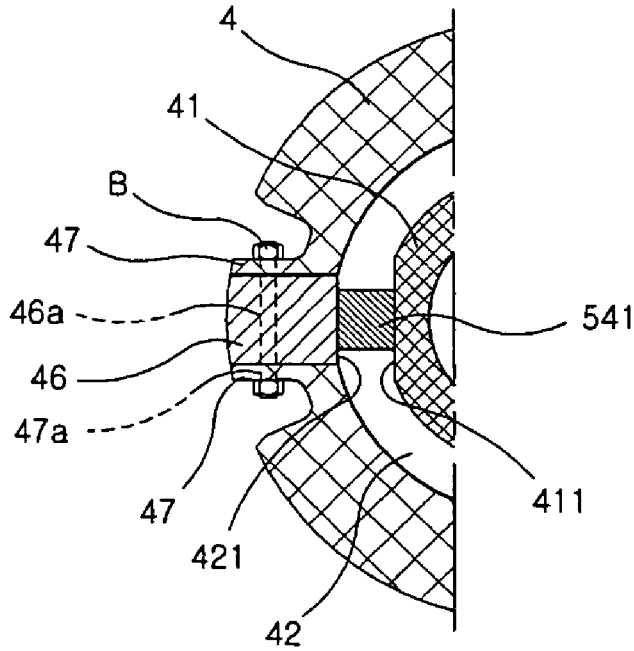
FIG. 14 is a cross-sectional view illustrating assembly of principal components of the compression unit of the orbiting vane compressor according to the eighth preferred embodiment of the present invention shown in FIG. 13.

FIG. 14 is a cross-sectional view illustrating assembly of principal components of the compression unit of the orbiting vane compressor according to the eighth preferred embodiment of the present invention shown in FIG. 13.

As shown in FIG. 14, the linear slider 541 is disposed such that the inner surface of the linear slider 541 comes into contact with the first horizontal contact surface 411 formed at the inner ring 41 of the cylinder 4, and then the slide housing 46 is inserted into the separation space of the cylinder 4 until the first horizontal contact surface 421 of the slide housing 46 comes into contact with the outer surface of the linear slider 541.

After the slide housing 46 is disposed in the separation space 45 while the fixing hole 46*a* of the slide housing 46 is aligned with the connection holes 47*a* formed at the supporting bars 47, the bolt B is inserted through one of the connection holes 47*a*, the fixing hole 46*a*, and the other connection hole 47*a*. As a result, the slide housing 46 is attached to the cylinder 4 while the second horizontal contact surface 421 of the slide housing 46 is in tight contact with the outer surface of the linear slider 541.

When the linear slider 541 is worn out, and therefore, the linear slider 541 must be replaced by a new one, the bolt B is removed from the supporting bars 47 and the slide housing 46, and then the slide housing 46 is separated from the separation space 45 of the cylinder 4. After that, the worn linear slider 541 is replaced with a new one. In this way, easy and convenient replacement of the linear slider 541 is accomplished.

Figure 15:
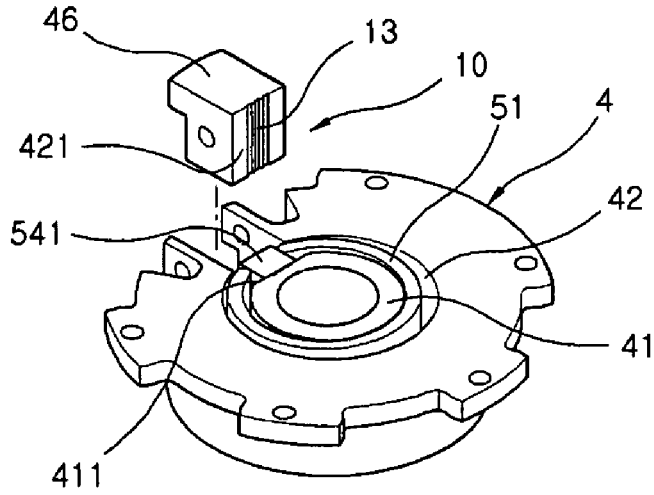
FIG. 15 is an exploded perspective view illustrating principal components of a compression unit of an orbiting vane compressor according to a ninth preferred embodiment of the present invention.
Figure 16:
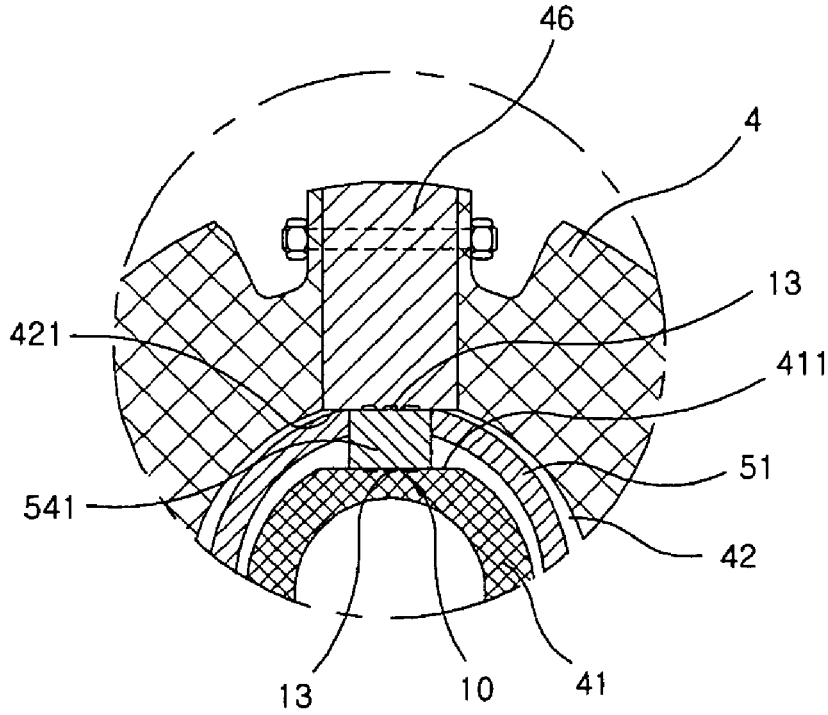
FIG. 16 is an enlarged cross-sectional view illustrating assembly of principal components of the compression unit of the orbiting vane compressor according to the ninth preferred embodiment of the present invention shown in FIG. 15.

FIG. 15 is an exploded perspective view illustrating principal components of a compression unit of an orbiting vane compressor according to a ninth preferred embodiment of the present invention, and FIG. 16 is an enlarged cross-sectional view illustrating assembly of principal components of the compression unit of the orbiting vane compressor according to the ninth preferred embodiment of the present invention shown in FIG. 15.

As shown in FIGS. 15 and 16, the leakage prevention part 10 of the compression unit of the orbiting vane compressor comprises a plurality of third labyrinth seals 13 formed at the first horizontal contact surface 411, which is formed at the inner ring 41 of the cylinder 4, and at the second horizontal contact surface 421, which is formed at the inner circumferential surface of the cylinder 4, in the direction perpendicular to the linear reciprocating direction of the linear slider 541, respectively.

Specifically, the third labyrinth seals 13 are vacant spaces formed at the horizontal contact surfaces 411 and 421 in the direction perpendicular to the linear reciprocating direction of the linear slider 541. When refrigerant gases compressed in the compression chambers of the annular space 42 flow to the suction chambers through gaps defined between the inner and outer surfaces of the linear slider 541 and the horizontal contact surfaces 411 and 421, respectively, the refrigerant gases abruptly expand in the third labyrinth seals 13. As a result, the pressure of the refrigerant gases is decreased.

As the pressure of the refrigerant gases, abruptly expanding in the third labyrinth seals 11, is decreased as described above, the refrigerant gases lose their energy. Consequently, the refrigerant gases stagnate in the third labyrinth seals 11, and therefore, the compressed refrigerant gases are prevented from passing through the gaps between the inner and outer surfaces of the linear slider 541 and the horizontal contact surfaces 411 and 421, respectively. In this way, leakage of the compressed refrigerant gases is prevented in a multi-stage fashion.

The second horizontal contact surface 421 is provided at the slide housing 46, which is detachably attached to the cylinder 4. Consequently, the third labyrinth seals 11 can be easily formed at the second horizontal contact surface 421 as well as the first horizontal contact surface 411.

As the circular vane 51 performs an orbiting movement in the cylinder 4, high-pressure compression chambers are formed in the cylinder 4 at one side of the linear slider 541 and low-pressure suction chambers are formed in the cylinder at the other side of the linear slider 541. Due to the difference in pressure between the high-pressure compression chambers and the low-pressure compression chambers, the compressed gases leak through the gaps between the inner and outer surfaces of the linear slider 541 and the horizontal contact surfaces 411 and 421, respectively.

The leaking compressed gases are introduced into the plurality of third labyrinth seals 11 formed at the horizontal contact surfaces 411 and 421, respectively, and stagnate in the third labyrinth seals 11. Consequently, the seal between the horizontal contact surfaces 411 and 421 and the inner and outer surfaces of the linear slider 541 is maintained.

As apparent from the above description, the present invention has the following effects.

According to the present invention, the sealing means can be easily manufactured, tight contact between the circular vane and the sealing means is improved, and the sealing means is more stably operated. Consequently, the present invention has the effect of facilitating easily manufacture of the sealing means, improving the seal between the compression chambers, and therefore, improving the performance of the orbiting vane compressor.

According to the present invention, interference between the circular vane and the inner circumferential surface of the cylinder is prevented. Consequently, the present invention has an effect of performing more stable orbiting movement of the circular vane.

According to the present invention, dead volume is prevented from being created between the circular vane and the sealing means. Consequently, the present invention has an effect of effectively preventing abnormal compression due to the refrigerant gas introduced into the dead volume, if the dead volume is created.

According to the present invention, leakage of the high-pressure refrigerant gases from the compression chambers to the suction chambers is minimized by the leakage prevention part. Consequently, the present invention has an effect of minimizing leakage of the refrigerant gases due to difference in pressure between the compression chambers and the suction chambers, and therefore, further improving compression efficiency of the orbiting vane compressor.

According to the present invention, the seal between the linear slider and the inner wall of the cylinder is accomplished by means of the refrigerant gas. Consequently, the present invention has an effect of maintaining the seal between the linear slider, which performs a linear reciprocating movement in the cylinder when the circular vane performs a high-speed orbiting movement in the cylinder, and the inner wall of the cylinder, and therefore, improving performance and reliability of the orbiting vane compressor.

According to the present invention, the linear slider, which performs a linear reciprocating movement in the annular space of the cylinder, when the circular vane performs am orbiting movement in the cylinder, for maintaining the seal between the low-pressure and high-pressure chambers, is detachably attached to the cylinder by means of a fixing unit, such as a bolt. Also, the gap between the linear slider and the cylinder is uniformly maintained. Consequently, the present invention has an effect of easily and efficiently assembling the orbiting vane compressor and improving reliability of the orbiting vane compressor.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An orbiting vane comprising:

a circular vane formed at an upper part of a vane plate, wherein the circular vane has an opening extending between outer and inner circumferences of the circular vane, the circular vane has horizontal cut surfaces provided at the outer circumference adjacent to and at opposing sides of the opening, the horizontal cut surfaces extending parallel to a horizontal contact surface provided on an inner surface of a cylinder.

2. The vane as set forth in claim 1, wherein the circular vane further comprises dead volume preventing protrusions at the inner circumference of the circular vane adjacent to and at opposing sides of the opening.

3. The vane as set forth in claim 1, further comprising a slider positioned in the opening.

4. The vane as set forth in claim 3, wherein the slider has dead volume preventing protrusions provided at an inner end of the slider.

5. The vane as set forth in claim 3, further comprising a leakage preventor provided at the slider.

6. The vane as set forth in claim 5, wherein the leakage preventor comprises at least one first labyrinth seal formed at each contact surface of the slider.

7. The vane as set forth in claim 6, wherein the at least one first labyrinth seal is provided in a direction perpendicular to the reciprocating direction of the slider.

8. A compressor for compressing refrigerant gas introduced into the compressor according to an orbiting movement of a circular vane provided in an annular space defined between an inner wall of a cylinder and an inner ring in the cylinder, wherein the compressor comprises:

a first horizontal contact surface provided on an outer circumference of the inner ring;

a second horizontal contact surface provided on the inner wall of the cylinder and extending parallel to the first horizontal contact surface;

a linear slider positioned in an opening of the circular vane, the linear slider performing a linear reciprocating movement along the first and second horizontal contact surfaces; and wherein the circular vane has horizontal cut surfaces provided at an outer circumference of the circular vane adjacent to and at opposing sides of an opening of the circular vane.

9. The compressor set forth in claim 8, wherein the circular vane further comprises dead volume preventing protrusions at an inner circumference of the circular vane adjacent to and at opposing sides of the opening of the circular vane.

10. The compressor as set forth in claim 8, wherein the linear slider has dead volume preventing protrusions provided at an inner end of the slider, so that a dead volume between an inner circumference of the circular vane and a horizontal cut surface of an inner ring positioned within the circular vane is prevented.

11. A compressor for compressing refrigerant gas introduced into the compressor according to an orbiting movement of a circular vane provided in an annular space defined between an inner wall of a cylinder and an inner ring in the cylinder, wherein the compressor comprises:

a first horizontal contact surface provided on an outer circumference of the inner ring;

a second horizontal contact surface provided on the inner wall of the cylinder and extending parallel to the first horizontal contact surface;

a linear slider positioned in an opening of the circular vane, the linear slider performing a linear reciprocating movement along the first and second horizontal contact surfaces; and wherein the cylinder has curved grooves, the curved grooves being formed at opposing sides of the second horizontal contact surface at an orbiting track of an outer circumference of the circular vane and adjacent to the opening of the circular vane.

12. The compressor as set forth in claim 11, wherein the circular vane has dead volume preventing protrusions at an inner circumference of the circular vane adjacent to and on opposing sides of the opening of the circular vane.

13. The compressor as set forth in claim 11 wherein the linear slider has dead volume preventing protrusions provided at an inner end of the slider, so that a dead volume between an inner circumference of the circular vane and a horizontal cut surface of an inner ring positioned within the circular vane is prevented.

14. A compressor for compressing refrigerant gas introduced into the compressor according to an orbiting movement of a circular vane provided in an annular space defined between an inner wall of a cylinder and an inner ring in the cylinder, wherein the compressor comprises:

a first horizontal contact surface provided on an outer circumference of the inner ring;

a second horizontal contact surface provided on the inner wall of the cylinder and extending parallel to the first horizontal contact surface;

a linear slider positioned in an opening of the circular vane, the linear slider performing a linear reciprocating movement along the first and second horizontal contact surfaces; and wherein a circumference of the cylinder is provided at a predetermined position with a separation space, and a slide housing being releasably positioned in the separation space, the slide housing being provided with the second horizontal contact surface.

15. The compressor as set forth in claim 14, wherein the cylinder is provided at opposite sides thereof adjacent to the separation space with a pair of supporting bars each having a connection hole, and the slide housing has a fixing hole formed therethrough in the lateral direction, the slide housing being attached to the cylinder by a fastener, the fixing hole of the slide housing being aligned with the connection holes of the supporting bars.

16. The compressor as set forth in claim 14, further comprising at least one third labyrinth seal provided at each of the first and second horizontal contact surfaces in a direction perpendicular to a linear reciprocating direction of the linear slider.

* * * * *